US007481692B2

(12) United States Patent
Bruder

(10) Patent No.: US 7,481,692 B2
(45) Date of Patent: Jan. 27, 2009

(54) CONSTRUCTIONAL SYSTEM

(75) Inventor: Paul Heinz Bruder, Fuerth (DE)

(73) Assignee: Bruder Spielwaren GmbH & Co. KG, Fuerth (DE)

( * ) Notice: Subject to any disclaimer, the term of this patent is extended or adjusted under 35 U.S.C. 154(b) by 50 days.

(21) Appl. No.: 11/130,951

(22) Filed: May 17, 2005

(65) Prior Publication Data

US 2005/0272301 A1 Dec. 8, 2005

(30) Foreign Application Priority Data

May 17, 2004 (DE) ..... 10 2004 024 395

(51) Int. Cl.
*A63H 33/04* (2006.01)
*A63H 33/10* (2006.01)

(52) U.S. Cl. ..... 446/122; 52/606; 446/111; 446/113; 446/121

(58) Field of Classification Search ..... 446/85, 446/108, 111, 113, 121, 122; 52/606; 141/331
See application file for complete search history.

(56) References Cited

U.S. PATENT DOCUMENTS

| | | | | | |
|---|---|---|---|---|---|
| 850,126 | A | * | 4/1907 | Bayley | 454/12 |
| 2,885,822 | A | * | 5/1959 | Onanian | 446/121 |
| 3,195,266 | A | | 7/1965 | Onanian | |
| 4,003,144 | A | | 1/1977 | Maddestra et al. | |
| 4,293,079 | A | * | 10/1981 | Lytle | 220/833 |
| 4,551,110 | A | | 11/1985 | Selvage et al. | |
| 5,826,394 | A | * | 10/1998 | Barton et al. | 52/592.1 |

FOREIGN PATENT DOCUMENTS

| | | |
|---|---|---|
| BE | 1010737 | 12/1998 |
| GB | 2041228 | 9/1980 |
| WO | 97/25121 | 7/1997 |
| WO | 99/02234 | 1/1999 |

* cited by examiner

*Primary Examiner*—John Ricci
(74) *Attorney, Agent, or Firm*—Dilworth & Barrese, LLP.

(57) ABSTRACT

A constructional system comprises a plurality of building blocks and one or more connectors. In order to propose an improved constructional system, the building block (1) is characterized by a square assembly opening (2) which is surrounded by an assembly funnel (3)(FIG. 1).

21 Claims, 16 Drawing Sheets

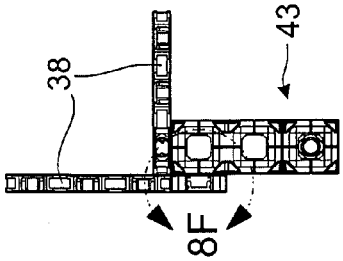
FIG. 8C
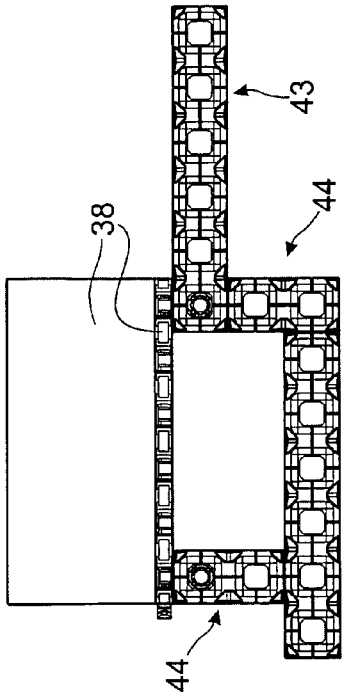
FIG. 8B
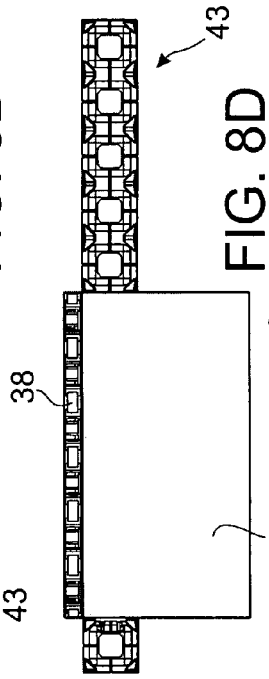
FIG. 8D
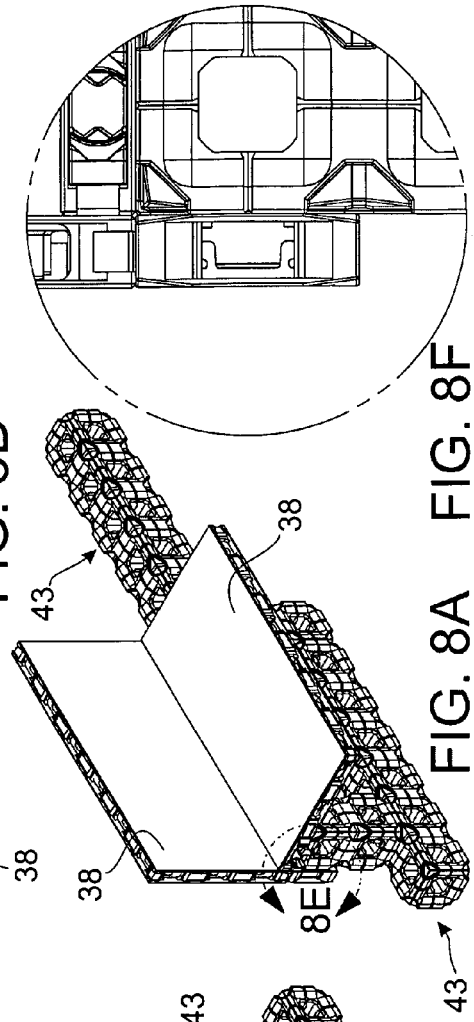
FIG. 8A
FIG. 8F
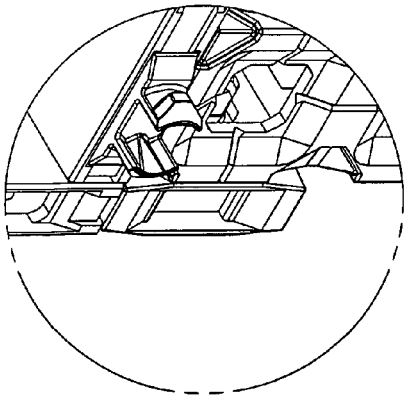
FIG. 8E
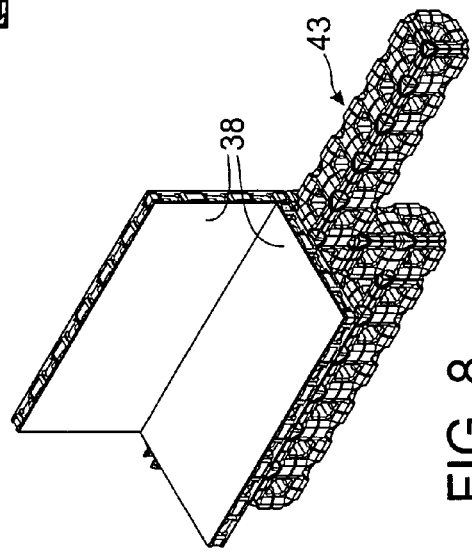
FIG. 8

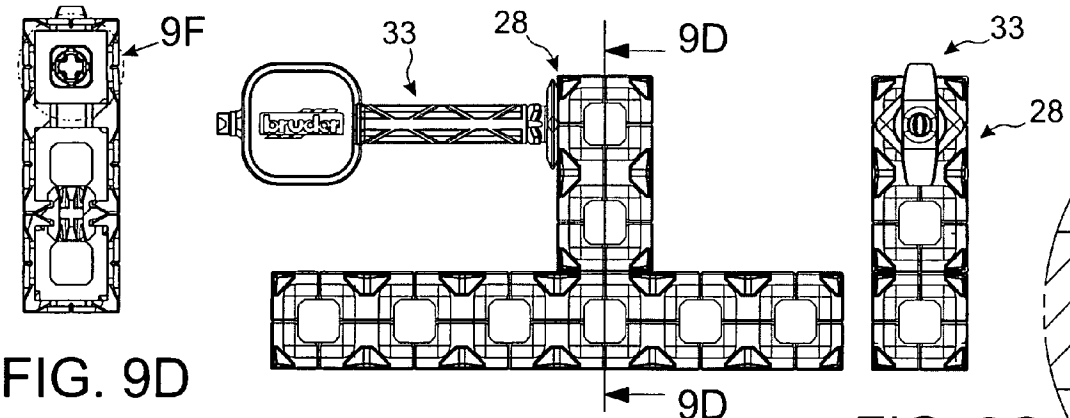
FIG. 9D
FIG. 9A
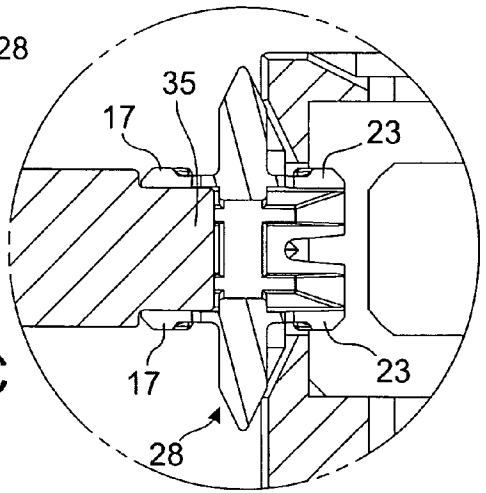
FIG. 9C
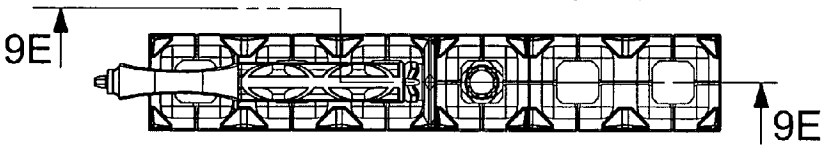
FIG. 9B
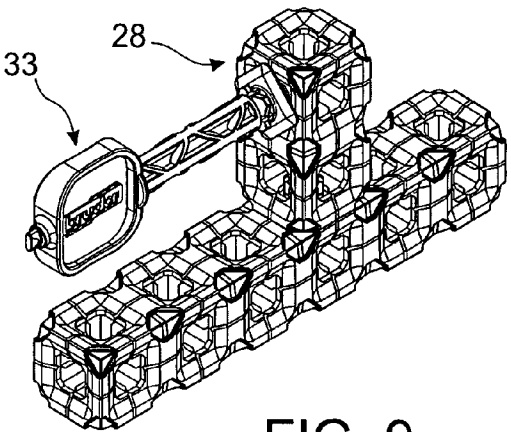
FIG. 9
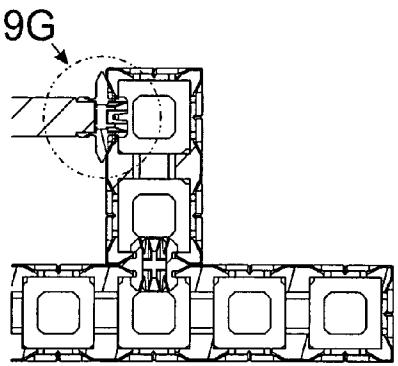
FIG. 9E
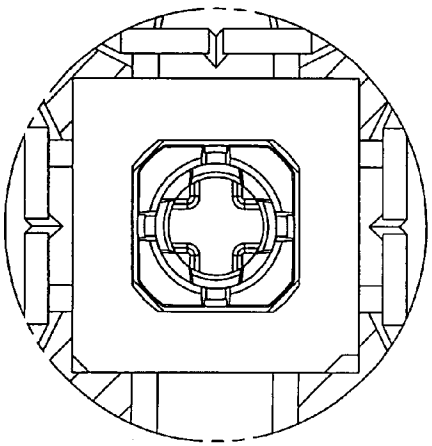
FIG. 9F
FIG. 9G

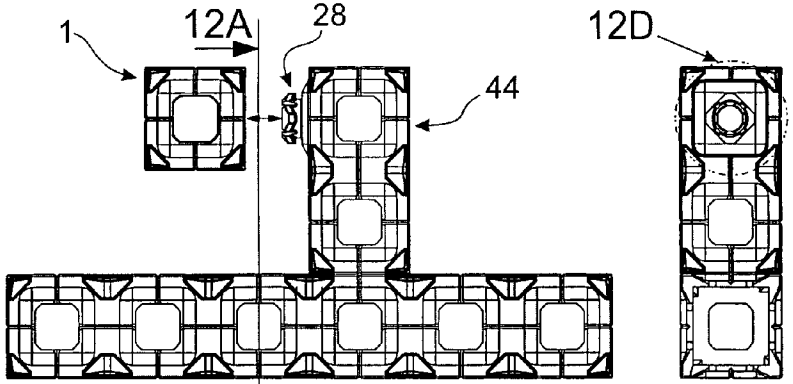
FIG. 12
FIG. 12A
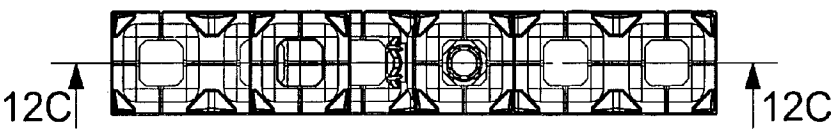
FIG. 12B
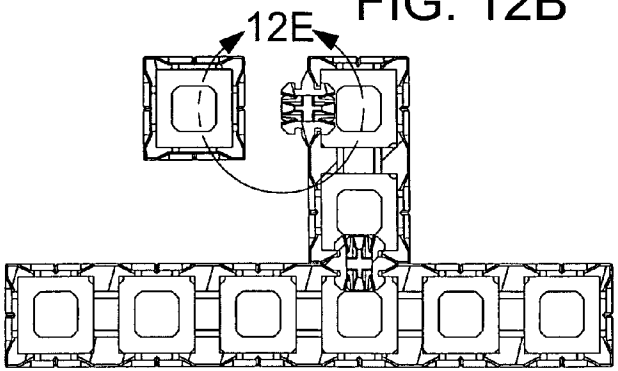
FIG. 12C
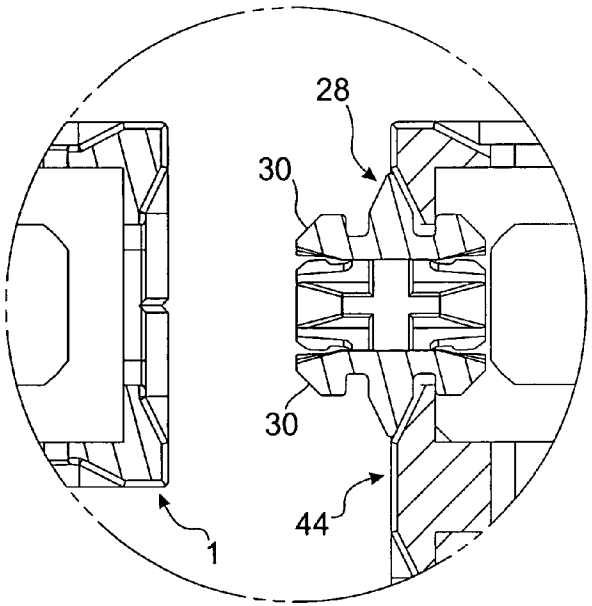
FIG. 12D
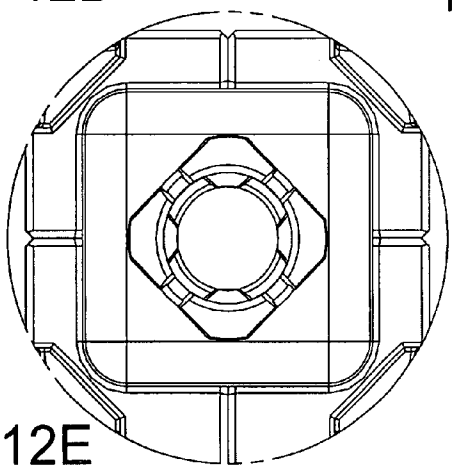
FIG. 12E

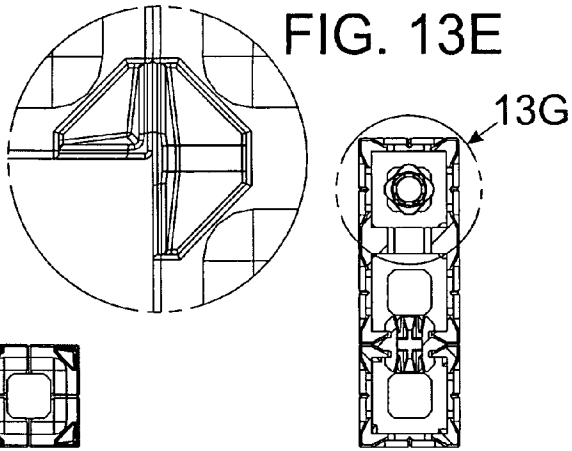
FIG. 13E
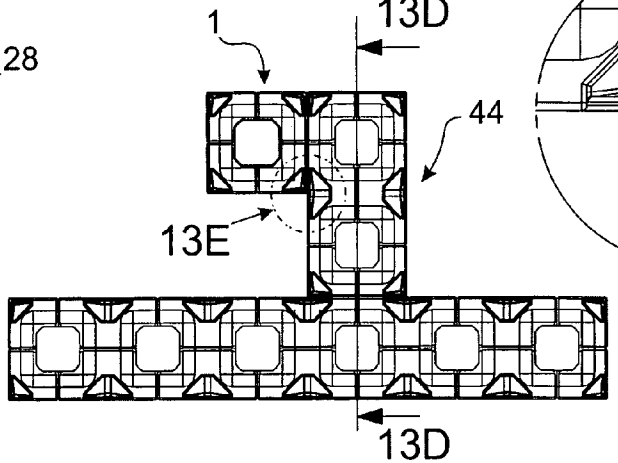
FIG. 13D
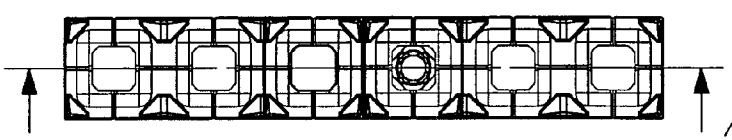
FIG. 13A
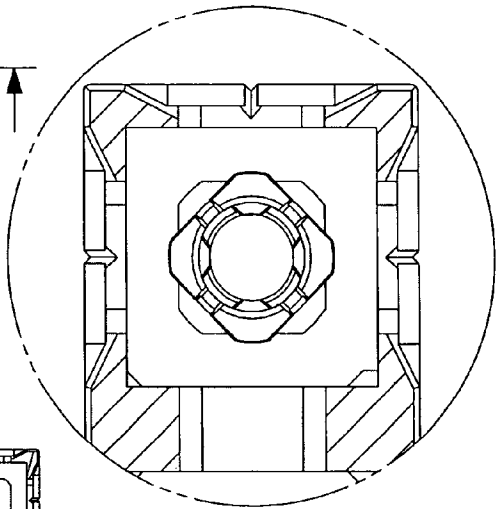
FIG. 13G
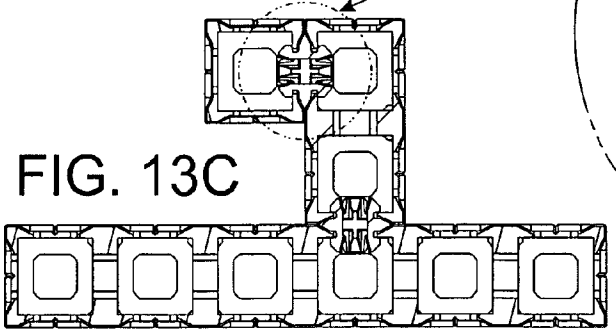
FIG. 13B
FIG. 13C
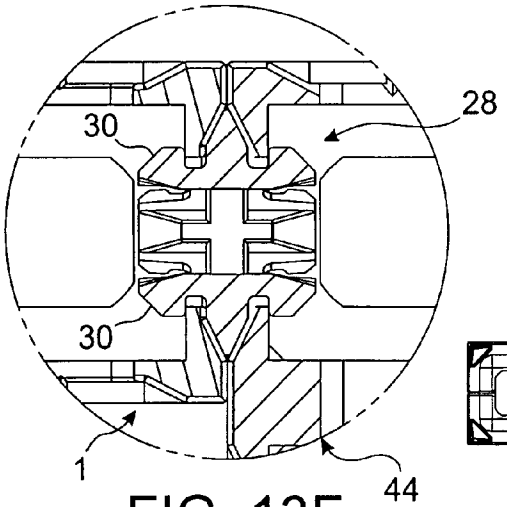
FIG. 13F
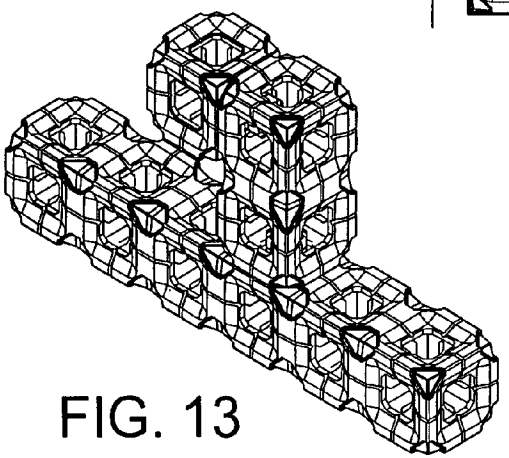
FIG. 13

33

33

33
44
1

36

15D
15D
36
1

1
15E
33
44

CONSTRUCTIONAL SYSTEM

BACKGROUND OF THE INVENTION

The invention relates to a building block, to a connector for building blocks of this kind, to a constructional system consisting of a plurality of building blocks, namely at least two building blocks, of this kind and at least one connector of this kind, and to an assembly and disassembly tool for connectors of this kind. The constructional system in accordance with the invention is in particular suitable as a toy. It can however also be used for constructional purposes, in particular for building and/or covering buildings or building parts. Structures of versatile shapes and sizes can be built with the constructional system in accordance with the invention. These structures can be used as toys. It is, however, also possible to use the structures which can be made with the constructional system for other purposes, for example as game landscapes, architectural models or the like.

The object of the invention is to propose a building block, a connector, a constructional system consisting thereof and an associated assembly and disassembly tool which can be used in a versatile manner.

SUMMARY OF THE INVENTION

A building block in accordance with the invention is characterized by a square assembly opening which is surrounded by an assembly funnel. A connector in accordance with the invention for connecting two building blocks of this kind is characterized by two latching noses and an assembly elevation. The constructional system in accordance with the invention is characterized by a plurality of building blocks, namely at least two building blocks, in accordance with the invention and one or more connectors in accordance with the invention.

The assembly opening of the building block and the assembly funnel which surrounds it as well as the latching noses and the assembly elevation of the connector are designed such that the latching noses of the connector can be releasably latched together with the assembly opening.

Advantageous further developments of the invention are described herein.

It is advantageous for adjacent sides of the square mounting opening to be connected by corner surfaces. The corner surfaces can be present at one or more or all corners of the square mounting opening. Furthermore, one or more or all corner surfaces can be planar. Alternatively or additionally, it is possible for one or more or all corner surfaces to be rounded. The rounding can be designed such that it represents a section of a circular cylindrical surface, with it being possible for the center of the circular cylinder to lie at the center of the square assembly opening.

It is advantageous for the assembly funnel to comprise oblique surfaces. The oblique surfaces can be designed to rise from the inside toward the outside. The angle of rise preferably amounts to 10° to 30°. It preferably lies at 15°.

In accordance with a further advantageous further development the assembly funnel comprises a circumferential terrace surface. The circumferential terrace surface preferably extends about the assembly opening. It preferably lies between the assembly opening and the preferably present oblique surfaces. The circumferential terrace surface is preferably planar.

A further advantageous further development is characterized in that the building block is designed as a polyhedron. It can be a regular polyhedron, for example a tetrahedron or a cube or another regular polyhedron, but also an irregular polyhedron such as a right parallelepiped or another irregular polyhedron.

It is advantageous for the building block to have a plurality of assembly openings. This is in particular advantageous when the building block is designed as a polyhedron. If the building block is designed as a regular polyhedron, it is in particular advantageous for an assembly opening to be formed at a plurality of or at all side surfaces of the polyhedron. If the building block is designed as an irregular polyhedron, in particular as a right parallelepiped, it is advantageous for a plurality of assembly openings to be provided at one or more or all side surfaces. The assembly openings can in particular be arranged in accordance with a regular pattern, in particular in a row or in a rectangle.

A further advantageous further development is characterized in that the building block is formed as an edged element. This is in particular advantageous when the building block is designed as a polyhedron.

In accordance with a further advantageous further development, the building block has a cut-out or recess at one or more or all comers. The cut-out is preferably designed such that when the building blocks are assembled, a disassembly tool can be used to separate the connected building blocks.

The connector in accordance with the invention for connecting two building blocks preferably comprises two further latching noses. The strength and reliability of the connection can thereby be improved.

A further advantageous further development is characterized in that two or four further latching noses and a further assembly elevation are provided on the opposite side of the connector. The connector can be releasably connected to a building block by the first named two or four latching noses. The second building block can be connected to the further latching noses present at the opposite side of the connector. The unit produced in this manner, which consists of two building blocks and a connector, can then be extended in an analogous manner, that is, in that a further connector is connected to a further assembly opening of one of the building blocks and in that a further building block is connected to the latching noses present on the opposite side of the connector. A structure consisting of building blocks and connectors can be successively built up in this manner. In this process, it is possible to introduce a respective connector at one or more outer surfaces of one or more building blocks, said connector having latching noses on one side only, and its other side being designed as a closure surface. A building part of this kind is also a connector in the sense of the present invention.

The assembly elevation can be designed as a roof surface or as a pyramid surface. If the connector has two latching noses, the assembly elevation is preferably designed as a roof surface. If the connector has four latching noses, the assembly elevation is preferably designed as a pyramid surface.

The releasable connection between a building block and a connector can be produced in that the latching noses of the connector are inserted into a diagonal of the square mounting opening and are then rotated by 45° by hand or with an assembly tool, so that they engage behind two oppositely disposed sides of the square mounting opening. The connection can be released by a rotation or backward rotation of the connector by 45°, and indeed by hand or with a disassembly tool. If the connector has two latching noses, it can be sufficient for the square mounting opening to comprise only a range of somewhat more than 45°, namely that range which is required in order to execute the described rotating-in movement. An assembly opening of this kind is also a square mounting opening in the sense of the present invention.

It is advantageous for one or more or all latching noses to be resilient. It is then possible to produce the connection of a connector to a building block without the described rotation by 45° in that the connector is placed in the correct position and is pressed into the assembly opening. The resilience of the latching noses is preferably designed such that it is possible to produce the connection by pressing in by hand.

Furthermore, in the case of resilient latching noses, it is possible to release the connection between a building block and a connector without the described rotation of the connector by 45°. The resilience of the latching noses is preferably designed such that the connection between the building block and the connector can be released by a disassembly tool. With a resilient design of the latching noses, it is possible to carry out the assembly and disassembly either by the described rotations by 45° or by hand, and indeed on the assembly by pressing in and on the disassembly by the use of a tool.

The assembly and disassembly tool in accordance with the invention for the connector in accordance with the invention comprises an eccentric protrusion which can be plugged into a corresponding mount of the connector. The eccentric protrusion preferably has a cross-shaped cross-section. In accordance with a further advantageous further development, the tool has a projecting wedge. This projecting wedge is preferably located on the side of the tool opposite to the eccentric protrusion. It is preferably designed such that it can be inserted into a cut-out, which can be provided at one corner of a building block, or into the total cut-out, which is formed by two adjacent cut-outs of this kind. The connected building blocks can be separated from one another by a rotation of the wedge, whereby the connection can be released.

BRIEF DESCRIPTION OF THE DRAWINGS

Embodiments of the invention will be explained in detail in the following with reference to the enclosed drawings. There are shown in the drawings:

FIG. 8 a structure which is put together from two bodies in accordance with FIG. 7, two bodies each consisting of two cubic edged elements and two base plates in accordance with FIG. 6, in two perspective views (FIGS. 8 and 8A), in a plan view (FIG. 8D), in a front view (FIG. 8B), in a side view (FIG. 8C) and in two enlarged perspective partial views (FIGS. 8E and 8F);

FIG. 9 a structure consisting of a body in accordance with FIG. 7 and a body which consists of two cubic edged elements, with an assembly and disassembly tool, in a perspective view, in a front view (FIG. 9A), in a plan view (FIG. 9B), in a side view (FIG. 9C), in two sectional views (FIGS. 9D and 9A) and in two enlarged perspective partial views (FIGS. 9F and 9G);

FIG. 12 to FIG. 12E the structure in accordance with FIGS. 9 to 11 with a cubic edged element which is additionally to be assembled, in different views and sections;

FIG. 13 to FIG. 13G the structure in accordance with FIG. 12 in the assembled state in different views;

DESCRIPTION OF THE PREFERRED EMBODIMENTS

Figure 1B:
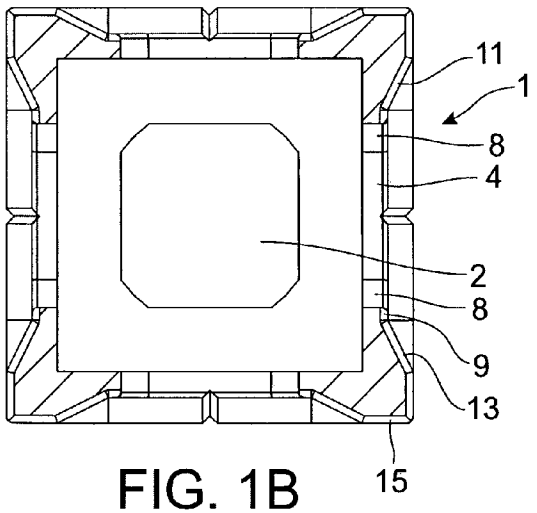
FIG. 1 a building block which is formed as a cubic edged element, in a perspective view, in a plan view (FIG. 1A) and in a cross-section (FIG. 1B)
Figure 1A:
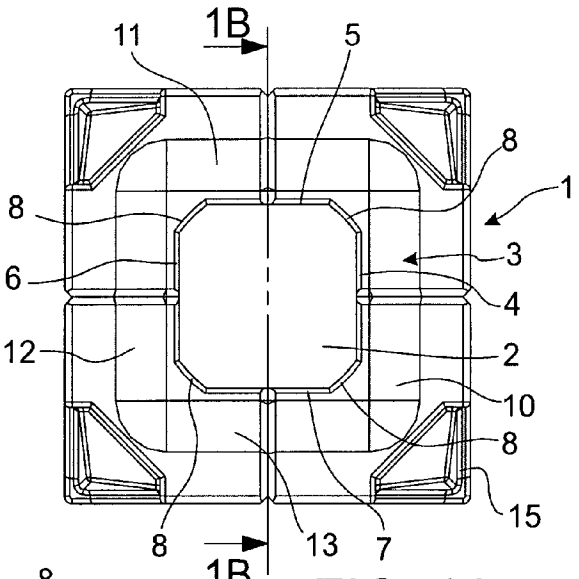
Figure 1:
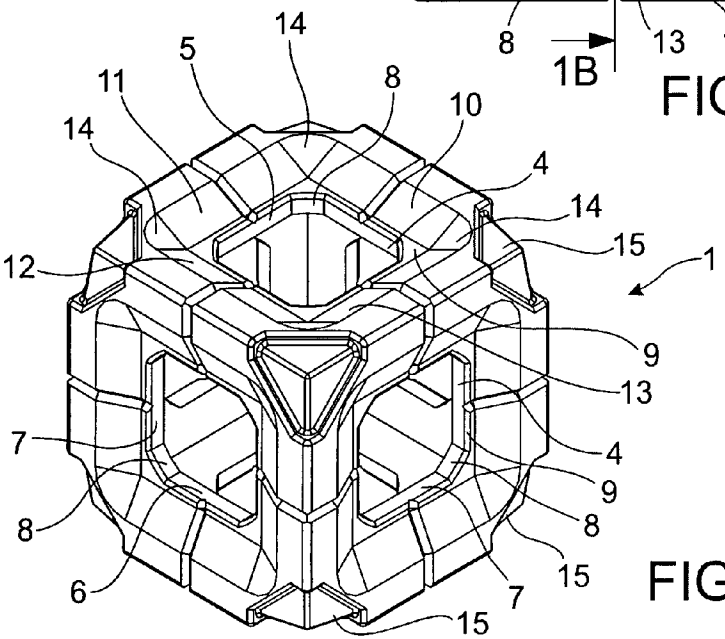

FIG. 1 shows a building block 1 which is designed as a regular polyhedron, namely as a cube. Furthermore, the building block 1 is designed as an edged element. A square mounting opening 2, which is surrounded by an assembly funnel 3, is provided in each of the six side surfaces.

The assembly opening 2 comprises four sides 4, 5, 6, 7. Two respective adjacent sides, for example sides 4 and 5, are connected by a corner surface 8. The corner surfaces 8 are parts of a circular cylindrical surface, with the center of the circular cylinder lying at the center of the square mounting opening 2.

The outer edges of the square mounting opening 2, that is the sides 4, 5, 6, 7 and the corner surfaces 8, are provided with a chamfer, whose angle amounts to 45° and which is adjoined by a circumferential, planar terrace surface 9. Instead of a chamfer, or in addition to it, a radius can also be provided. The circumferential terrace surface 9 lies between the sides of the square mounting opening 2 and the assembly funnel 3.

The assembly funnel 3 comprises four oblique surfaces 10, 11, 12, 13, which extend at an angle of approximately 15° with respect to the plane of the assembly opening 2. Two respective adjacent oblique surfaces 10-13 are connected to one another by a rounded oblique connecting surface 14.

The building block 1 has a cut-out 15 at each of its corners which covers the three adjacent side surfaces.

Figure 2C:
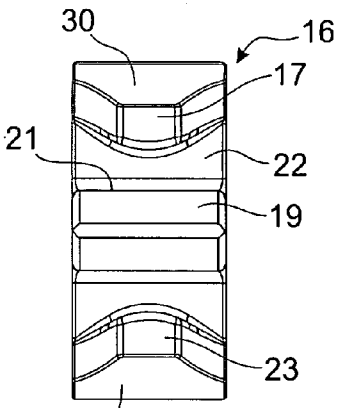
FIG. 2 a connector with two latching noses on each side, in a perspective view, in a plan view (FIG. 2A), in a side view (FIG. 2B), in a front view (FIG. 2C) and in a cross-section (FIG. 2D)
Figure 2B:
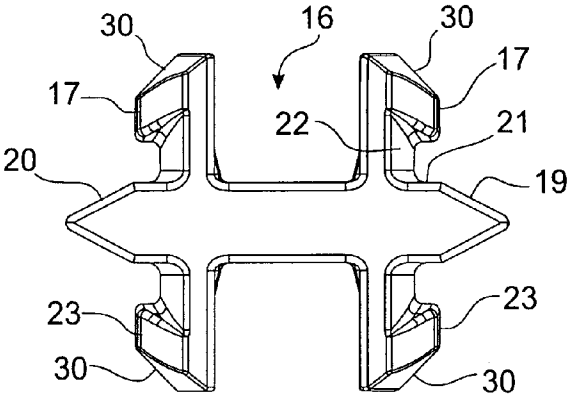
Figure 2A:
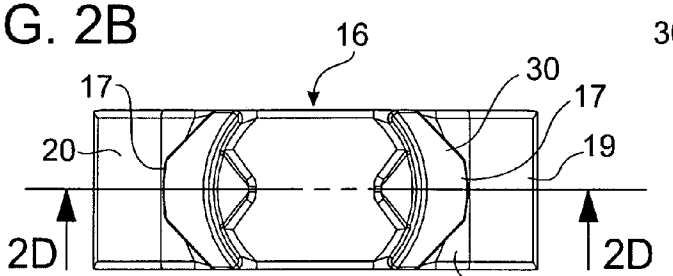
Figure 2D:
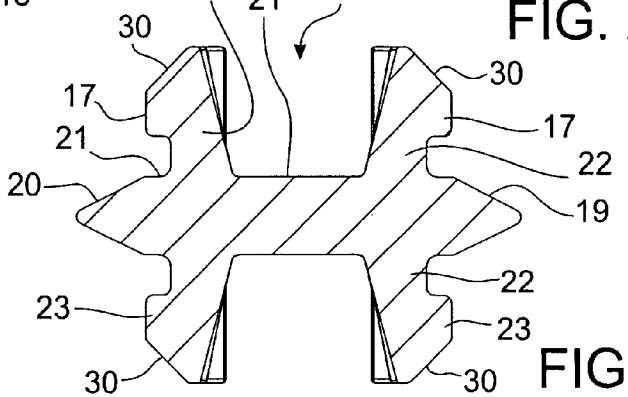
Figure 2:
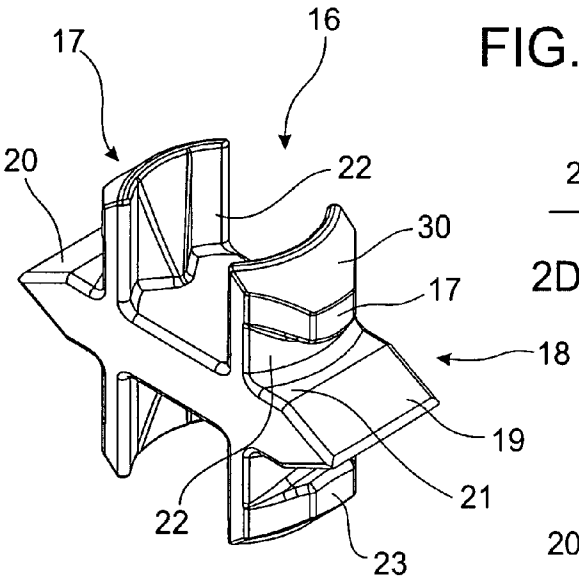

FIG. 2 shows a connector 16 which serves to connect two building blocks 1. The connector 16 comprises two latching noses 17 and an assembly elevation 18, which is formed as a roof surface. The assembly elevation 18 comprises two oblique surfaces 19, 20 which are inclined at an angle which corresponds substantially to the angle of the oblique surfaces 10-13 of the building block 1. Their upper end edges are connected by a platform surface 21, from which the elevations 22 protrude upwardly at which the outwardly protruding latching noses 17 are provided. The latching noses 17 are accordingly located at a distance above the platform surface 21, with this distance corresponding substantially to the height of the side surfaces 4-7 of the building block 1. Furthermore, the lower side of the latching noses 17 is rounded, and indeed such that the distance between the lower side of the latching nose and the platform surface 21 is lowest at the center and increases outwardly. The smallest distance at the center corresponds substantially to the height of the sides 4-7 of the square mounting opening 2 of the building block 1. This distance can also be slightly lower, so that the connector is reliably clamped to the assembly opening 2 in the assembled state.

On the side of the connector 16 disposed opposite to the latching noses 17, two further latching noses 23 are provided which are formed symmetrically to the latching noses 17. The connector 16 is formed symmetrically as a whole, so that the lower side with the two further latching noses 23 corresponds to the explained upper side and do not have to be described again.

Figure 3C:
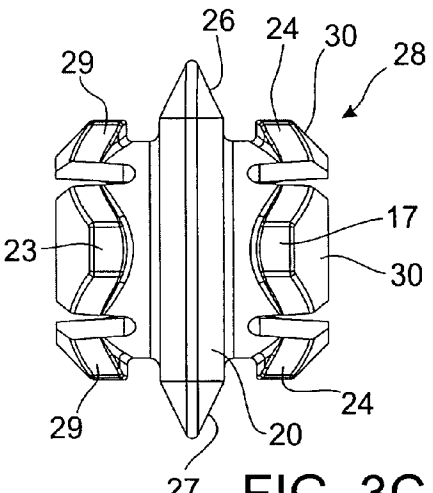
FIG. 3 a connector with four latching noses on each side in two perspective views (FIGS. 3 and 3A), in a plan view (FIG. 3B), in a side view (FIG. 3C) and in a cross-section (FIG. 3D)
Figure 3B:
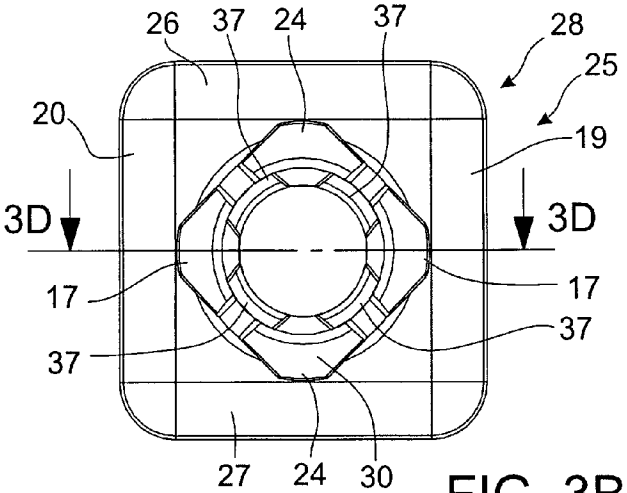
Figure 3A:
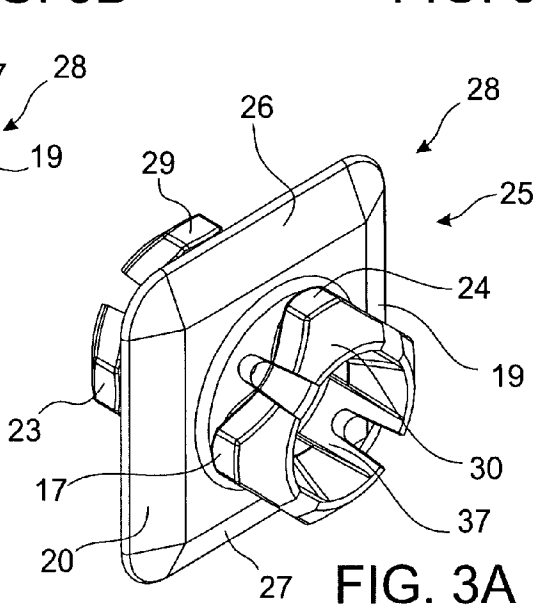
Figure 3D:
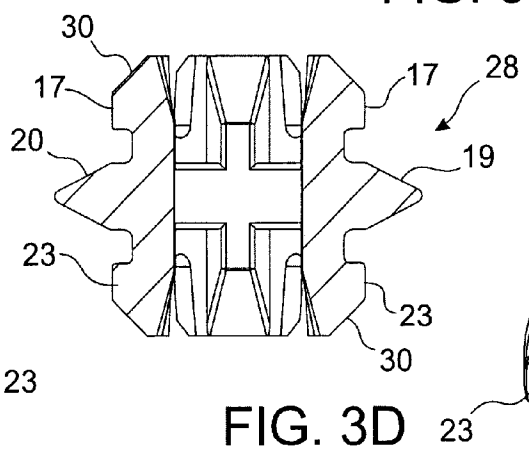
Figure 3:
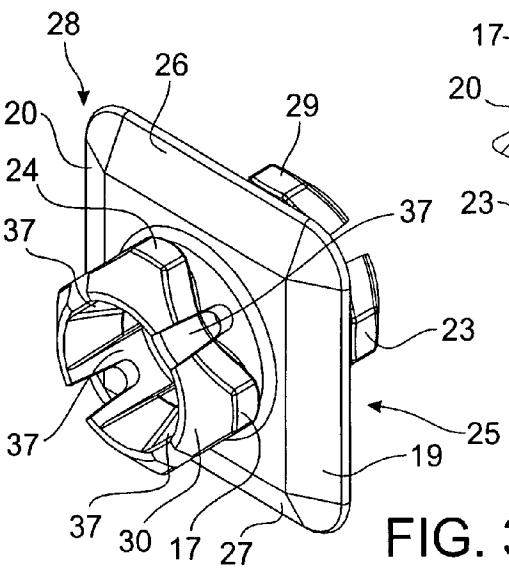

FIG. 3 shows a connector 28, in which in addition to the two latching noses 17, two further latching noses 24 are provided on the upper side. The further latching noses 24 lie between the latching noses 17. The assembly elevation 25 is made as a pyramid surface. In addition to the oblique surfaces 19, 20, it comprises two further oblique surfaces 26, 27. In a corresponding manner, two further latching noses 29 are provided on the lower side of the connector 28 in addition to the two latching noses 23. In other respects as well, the lower side of the connector 28 is made symmetrically to the described upper side so that it does not have to be described again.

To assemble a connector 16 or 28 with a building block 1, the connector 16, 28 is introduced into the square mounting opening 2 in a position which is rotated by 45°, and indeed such that the latching noses 17 and, where appropriate 24, are disposed opposite to the corner surfaces 8. The spacing between oppositely disposed latching noses 17 and/or 24 is dimensioned such that it is somewhat lower than the diagonal of the assembly opening 2, that is the distance between two diagonally oppositely disposed corner surfaces 8. The latching noses 17, and where appropriate 24, pass through the assembly opening 2 until the assembly elevation 18 and/or 25 makes contact with the assembly funnel 3. The connector 16 or 28 is subsequently rotated by 45°. Since the assembly elevation 18 and/or 25 at first lies diagonally in contact, the distance between the connector 16 or 28 and the building block 1 decreases in the course of this movement according to the contour of the lower side of the latching noses. In the final position the latching noses 17 and/or 24 lie below the side surfaces 4-7 of the square mounting opening 2. They are latched there.

The just described, latched position can also be achieved in that the connector 16 or 28 is positioned on the assembly opening 2 in the described final position and is pushed into the assembly opening 2 by hand. As a result of the resilience of the elevations 22 supporting the latching noses 17, 24, the latching noses 17, 24 yield inwardly. This inward resilient movement is assisted by run-in ramps 30 which are provided above the latching noses 17.

Figure 4D:
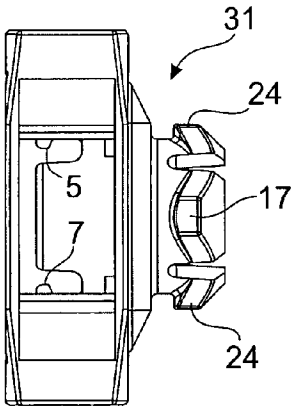
FIG. 4 an intermediate piece in two perspective views (FIGS. 4 and 4A), in a plan view (FIG. 4C), in a front view (FIG. 4B), in a side view (FIG. 4D) and in a cross-section (FIG. 4E)
Figure 4A:
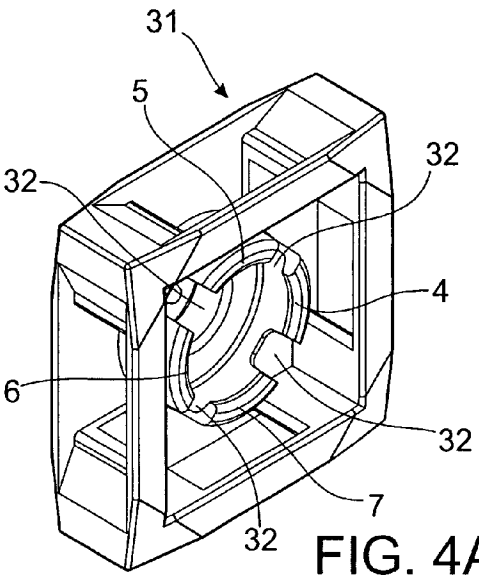
Figure 4B:
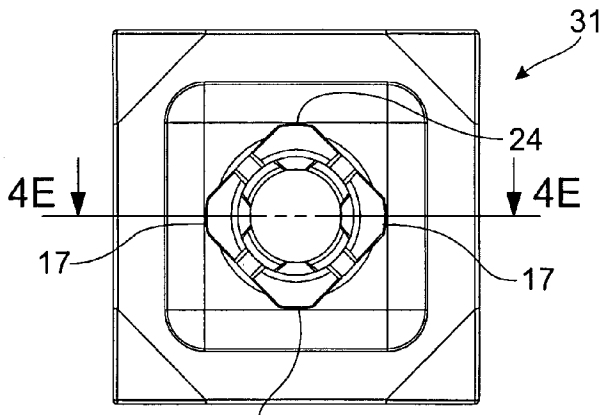
Figure 4C:
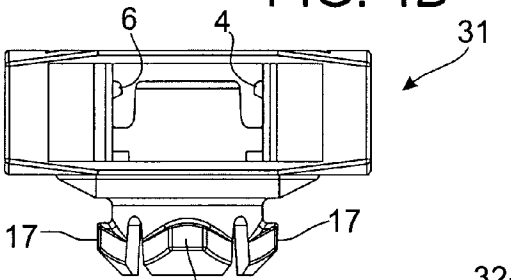
Figure 4E:
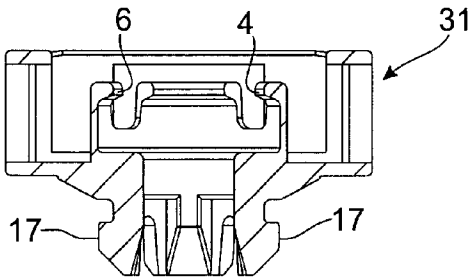
Figure 4:
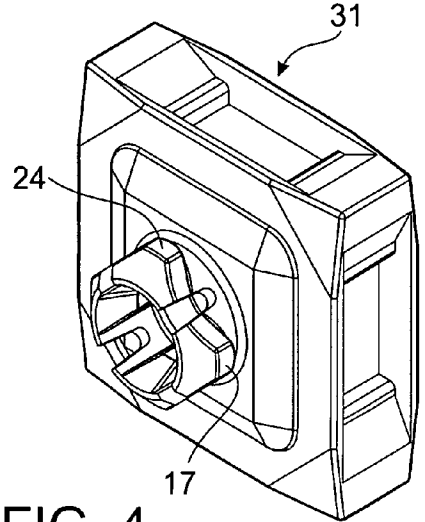

FIG. 4 shows a building block which is made as an extension piece 31. One side is made like the upper side (or the lower side) of the connector 28 in accordance with FIG. 3. The other side is made—in its functional parts—like the assembly opening 2 of the building block 1 in accordance with FIG. 1. It comprises sides 4, 5, 6, 7, which can be engaged behind by the latching noses 17, 24. Cut-outs 32 are respectively located between adjacent sides, and the latching noses 17, 24 pass through them on the assembly until the latching noses engage behind the sides 4-7. By a subsequent rotation by 45°, the connector 16, 28 can be latched together with the sides 4-7.

When the extension piece 31 with its latching noses 17, 24 is connected to a building block 1, the sides 4-7 which lie on the other side of the extension piece, together with the cut-outs 32, form a connection piece for a further connector 16, 28.

Figures 5, 5A, 5B, 5C, 5D, 5E:
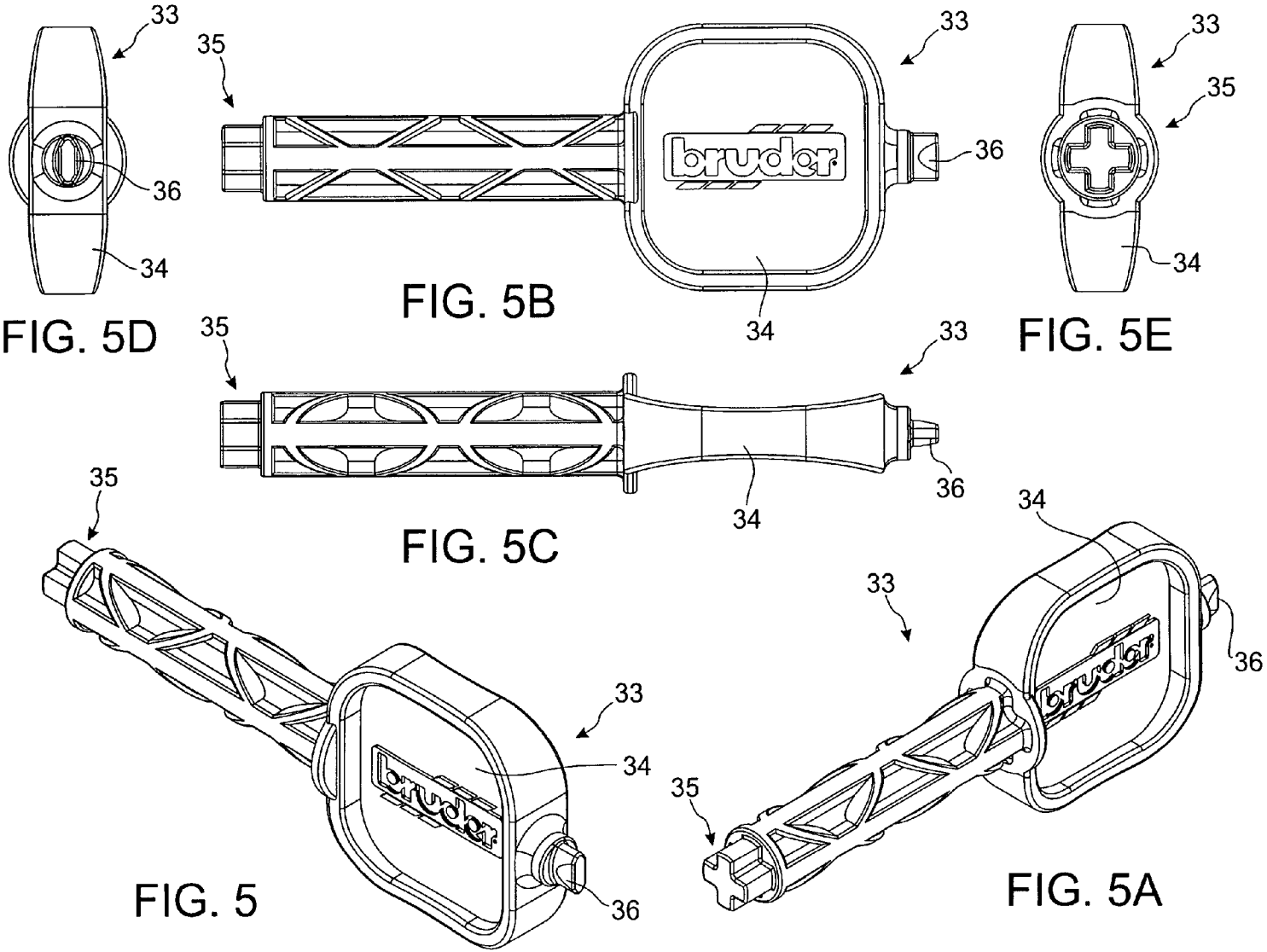
FIG. 5 an assembly and disassembly tool in two perspective views (FIGS. 5 and 5A), in a plan view (FIG. 5C), in a side view (FIG. 5B), in a front view (FIG. 5D) and in a rear view (FIG. 5E)

The assembly and disassembly tool 33 which is shown in FIG. 5 comprises a handle part 34, an eccentric protrusion 35 and a projecting wedge 36, which is located on the side of the handle part 34 disposed opposite the eccentric protrusion 35. The eccentric protrusion 35, which is provided on the end of a shaft which is connected to the handle part 34, has a cross-shaped cross-section. The four protrusions of the cross-shaped cross-section can be introduced into the gaps 37 provided between adjacent latching noses 17, 24 of the connector 16, 28. A rotationally fixed connection between the cross-shaped cross-section and the connector is thereby established.

Figure 6B:
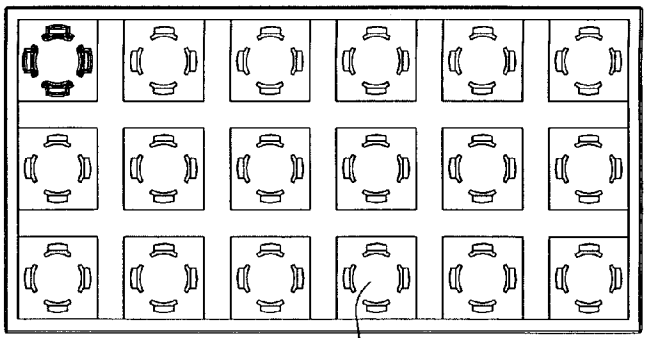
FIG. 6 a base plate with a plurality of assembly openings in a perspective view, in a plan view (FIG. 6A), in a front view (FIG. 6B), in a rear view (FIG. 6C), in a side view (FIG. 6D) and in an enlarged perspective partial view (FIG. 6E)
Figure 6D:
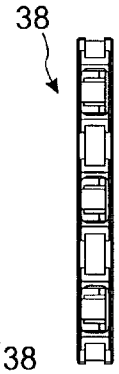
Figure 6C:
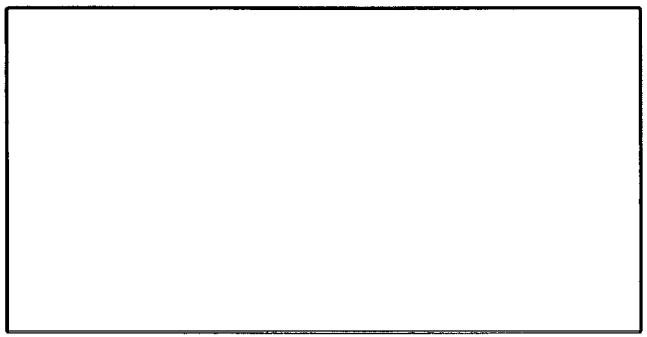
Figure 6E:
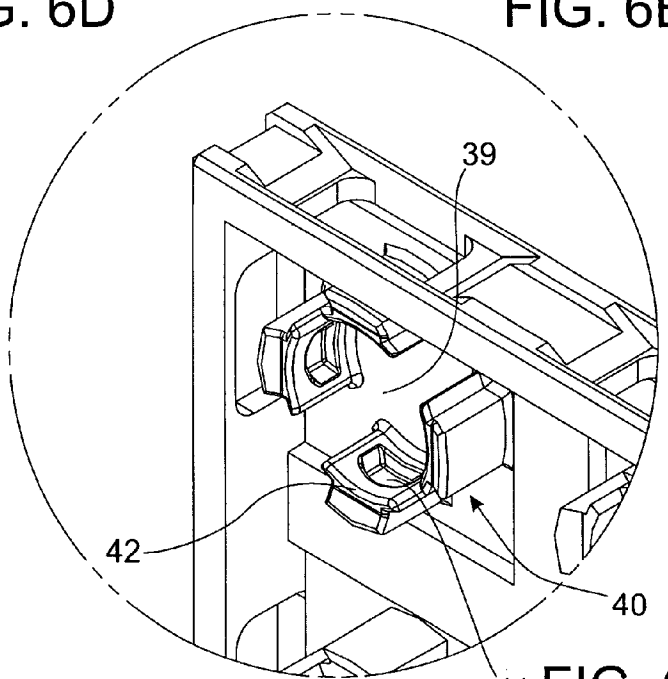
Figure 6A:
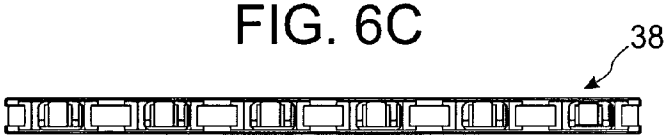
Figure 6:
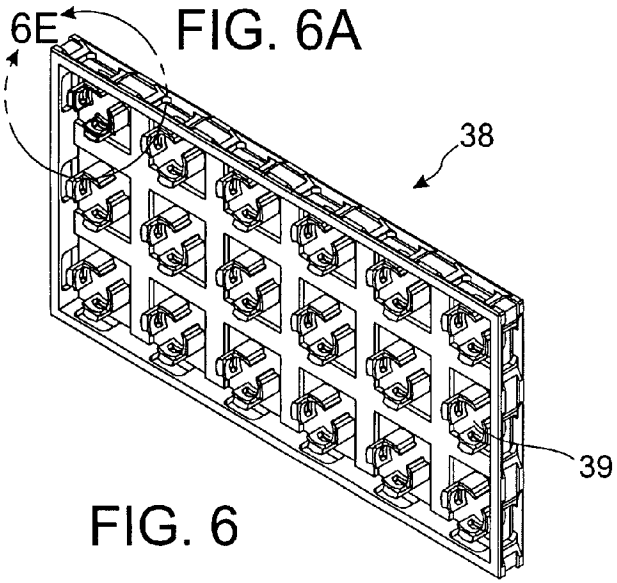

FIG. 6 shows a base plate 38, which is made substantially planar and has an arrangement of 3×6=18 mounts 39, whose functional constituents correspond to those of a square mounting opening 2 of the building block 1. Four window parts 40, at whose respective centre a window 41 is formed, protrude from the base surface of the base plate for each mount 39. The region 42 above the window 41 in each case forms one side 4-7 of the square mounting opening 2 which can be engaged behind by a latching nose 17, 24. Gaps are provided in each case between the window parts 40. The base plate 38 can be made as a covering plate, a wall plate, a facade plate, a roof plate or a similar plate. The surface of the base plate 38 which faces away from the mounts 39 can be made as a viewing surface. The surface and/or structure of the viewing surface can be made as a constructional plate (covering plate, wall plate, facade plate, roof plate, etc.). It can in particular be made as an imitation of a constructional plate of this kind.

Figure 7C:
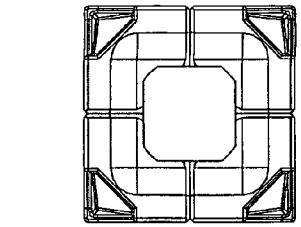
FIG. 7 a building block which is formed as a right parallelepiped edged element and which consists of six cubic edged elements in accordance with FIG. 1 which are arranged in a row, in two perspective views (FIGS. 7 and 7A), in a plan view (FIG. 7B), in a side view (FIG. 7C), in a front view (FIG. 7D) and in an enlarged perspective partial view (FIG. 7E)
Figure 7B:
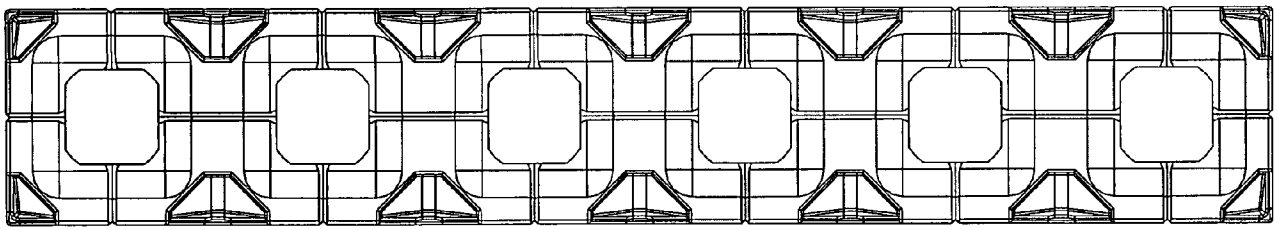
Figure 7D:
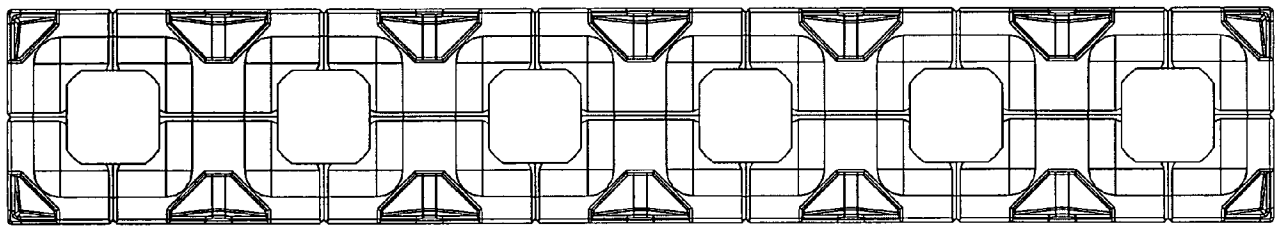
Figure 7A:
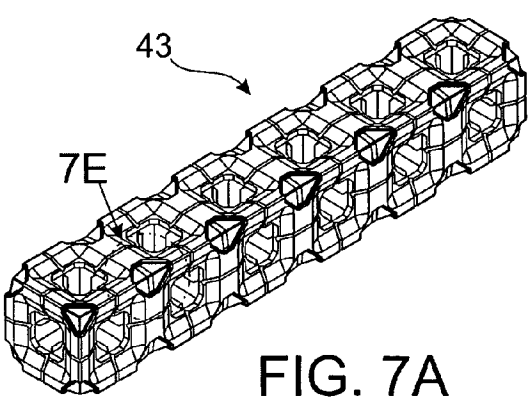
Figure 7E:
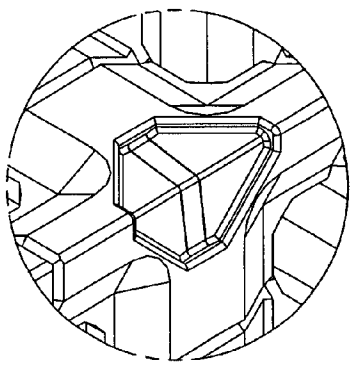
Figure 7:
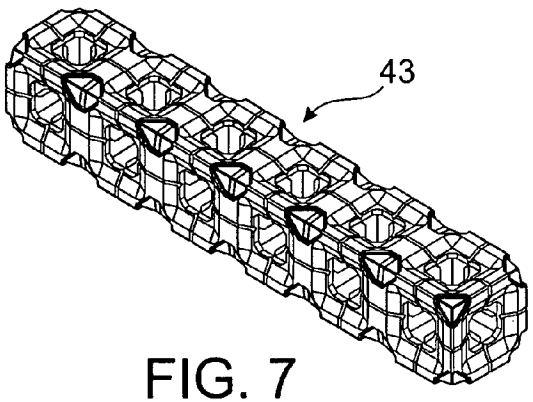

FIG. 7 shows a right parallelepiped building block 43 which consists of six cubic building blocks in accordance with FIG. 1 which are arranged in a row, with the building block 43 being in a single piece in accordance with FIG. 7. It serves to build up larger structures. Through the use of a right parallelepiped building block 43 in accordance with FIG. 7, it is not necessary to first put together six cubic building blocks in accordance with FIG. 1.

FIG. 8 shows a structure which comprises two right parallelepiped building blocks 43 in accordance with FIG. 7, two base plates 38 in accordance with FIG. 6 and two further building blocks 44 as well as the associated connectors. The right parallelepiped building blocks 44 each consist of two cubic building blocks in accordance with FIG. 1. As can be seen from FIG. 8, the sides of the base plates 38 disposed opposite the mounts 39 are designed as planar end surfaces. In this way, it is possible to make the viewing surface or utility surface which faces the user completely planar and to hide the remaining structure behind it.

FIG. 9 shows the appendage of the eccentric protrusion 35 of the assembly and disassembly tool 33 which has a cross-shaped cross-section to a connector 28 after the complete introduction of the latching noses 23 into the assembly opening 2, with the latching noses 23 still lying opposite to the corner surfaces 8.

Figure 10E:
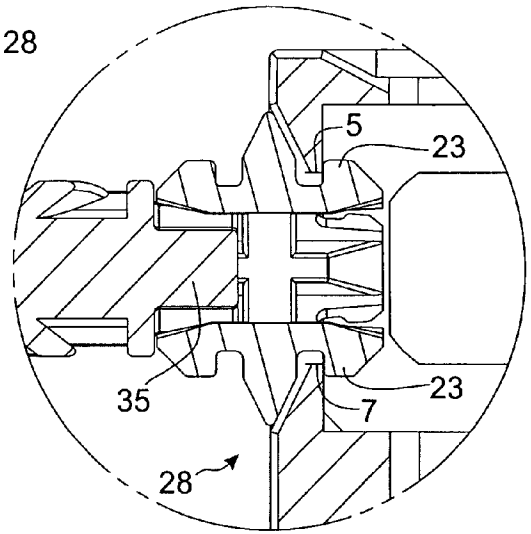
FIG. 10 to FIG. 10E the structure in accordance with FIG. 9 with the tool rotated by 45°.
Figure 10:
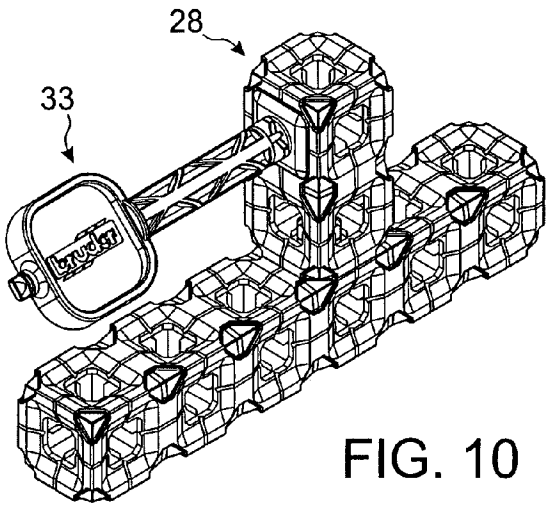
Figure 10B:
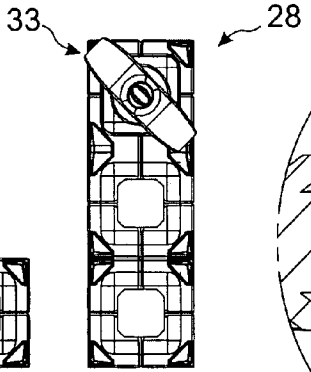
Figure 10A:
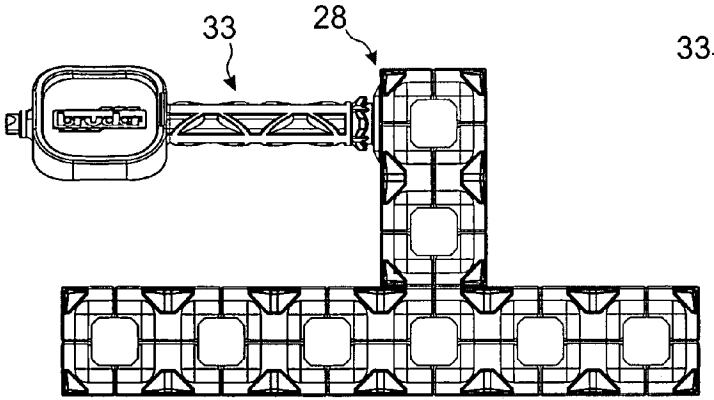
Figure 10C:
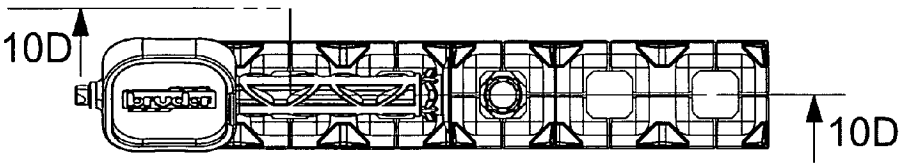
Figure 10D:
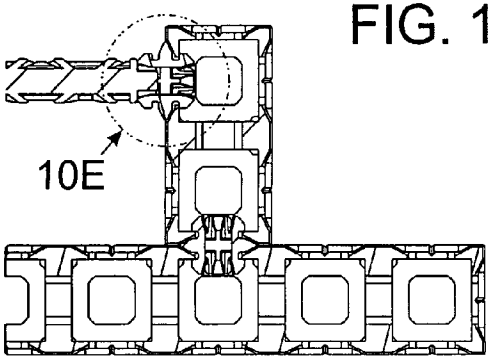

FIG. 10 shows the assembled state, in which the connector 28 has been brought by the tool 33 by 45° into the final position, in which the latching noses 23 are latched together with sides 5, 7 of the assembly opening 2.

Figure 11B:
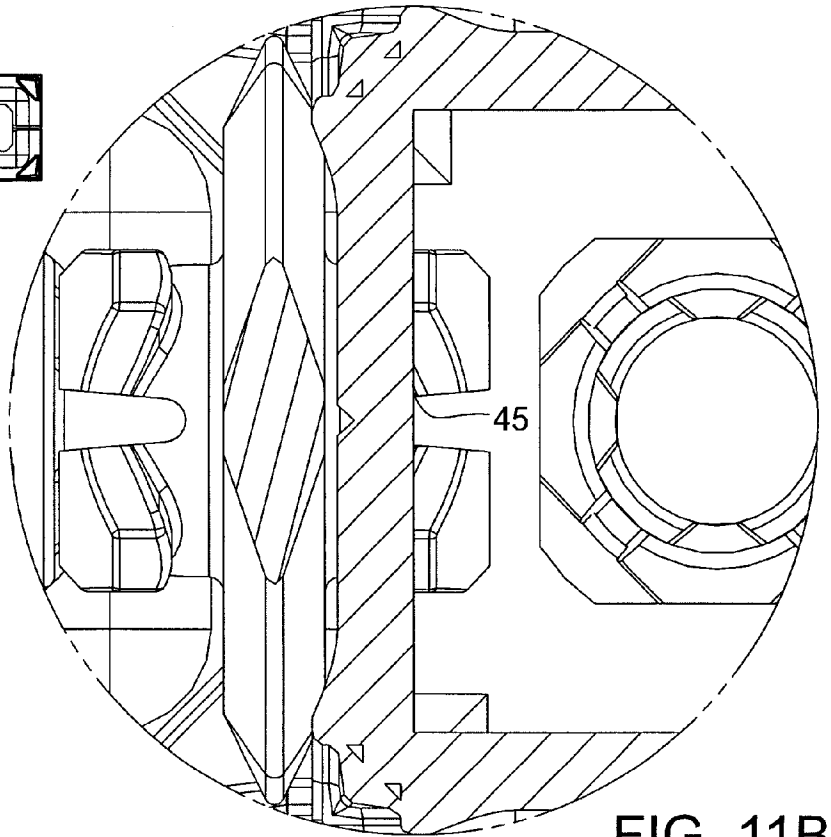
FIG. 11 to FIG. 11B the structure in accordance with FIGS. 9 and 10 with a modified enlarged partial view.
Figure 11:
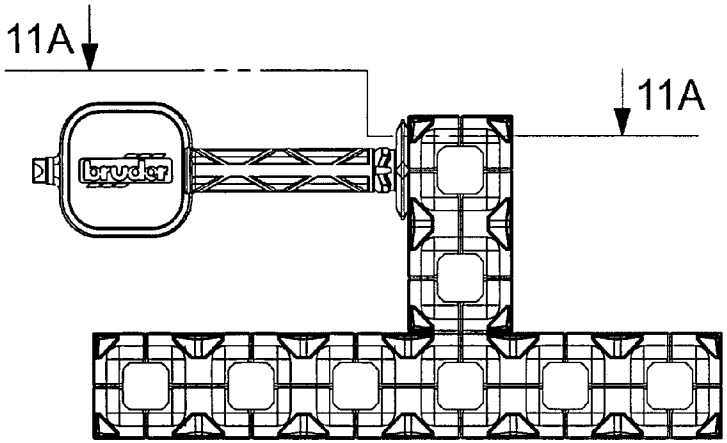
Figure 11A:
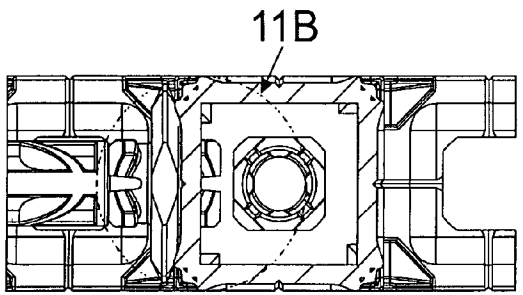

FIG. 11 shows the initial edge 45, through which the assembly is facilitated.

In FIG. 12, the hand assembly is illustrated. The building block 1 is to be connected to the building block 44. The connector 28 is already connected to an assembly opening 2 of the building block 44. The building block 1 is pressed out of the position shown in FIG. 12 onto the parts of the connector 28 which protrude from the building block 44 until the position shown in FIG. 13 is reached. This connection is made possible by the run-in ramps 30 of the connector 28.

Figures 14, 14A, 14B, 14C, 14D, 14E, 14F, 14G:
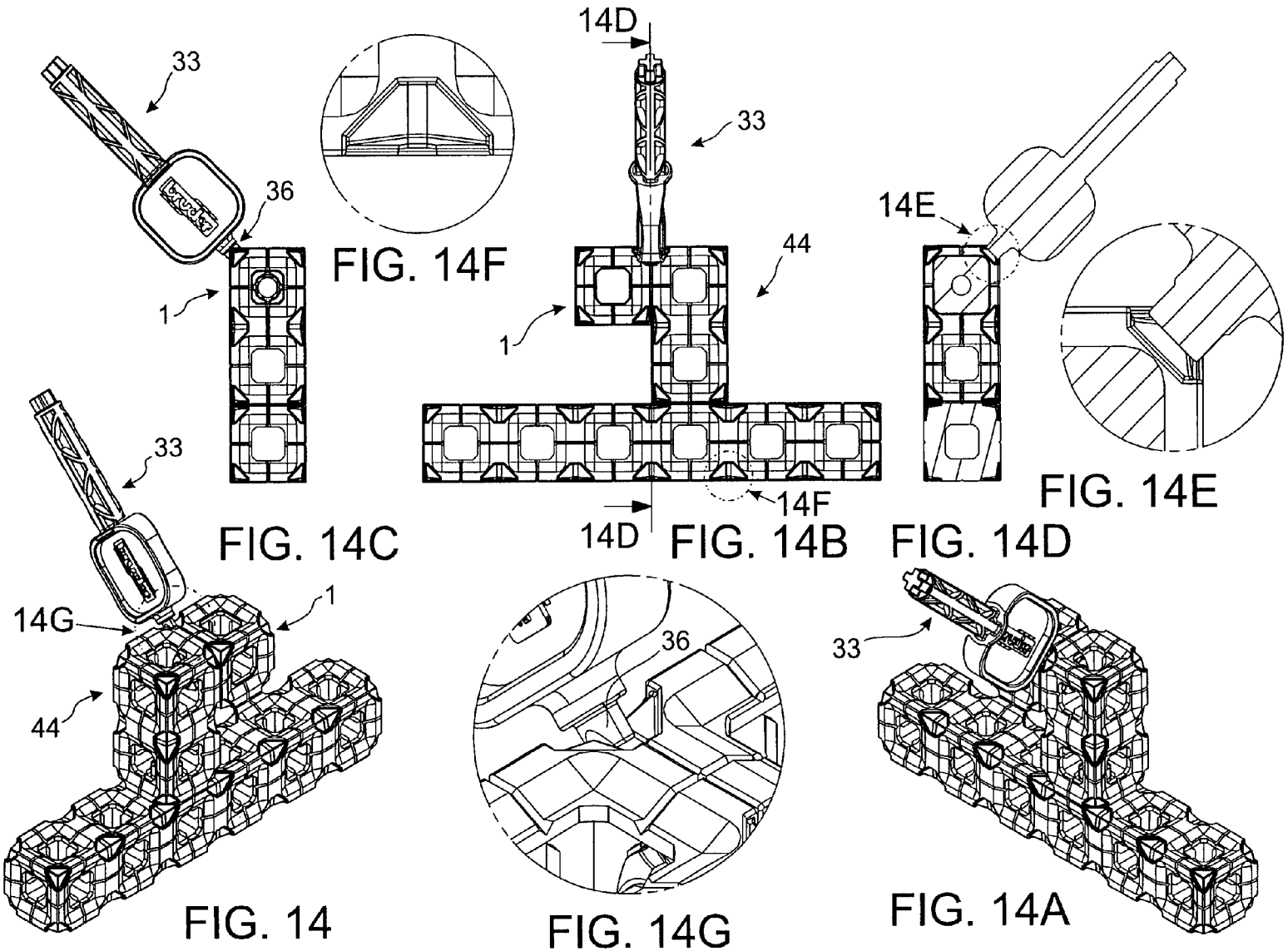
FIG. 14 to FIG. 14G the structure in accordance with FIG. 13 with applied disassembly tool.
Figures 15, 15A, 15B, 15C, 15D, 15E:
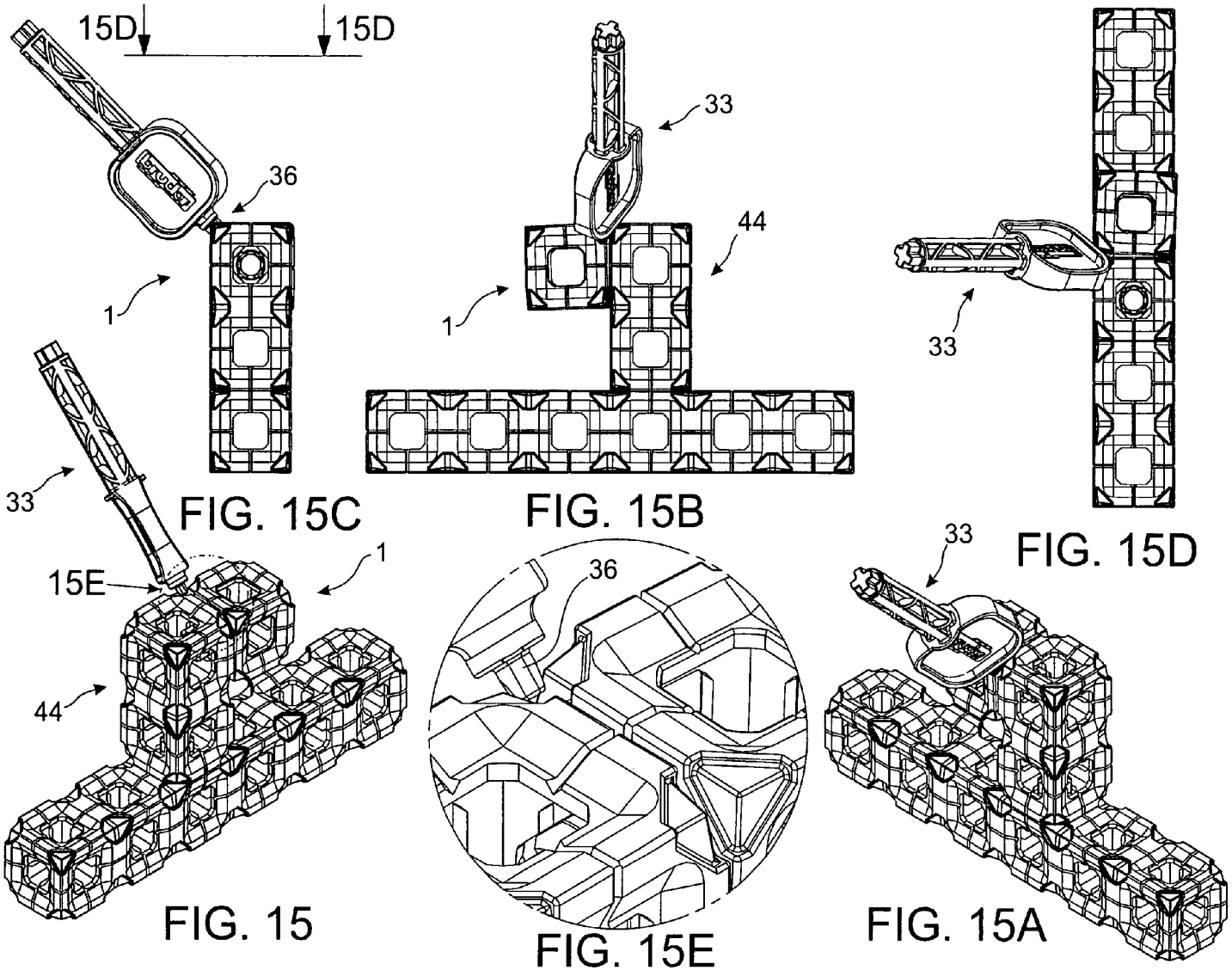
FIG. 15 to FIG. 15D the structure in accordance with FIG. 14 with partly rotated disassembly tool.
Figures 16, 16A, 16B, 16C, 16D:
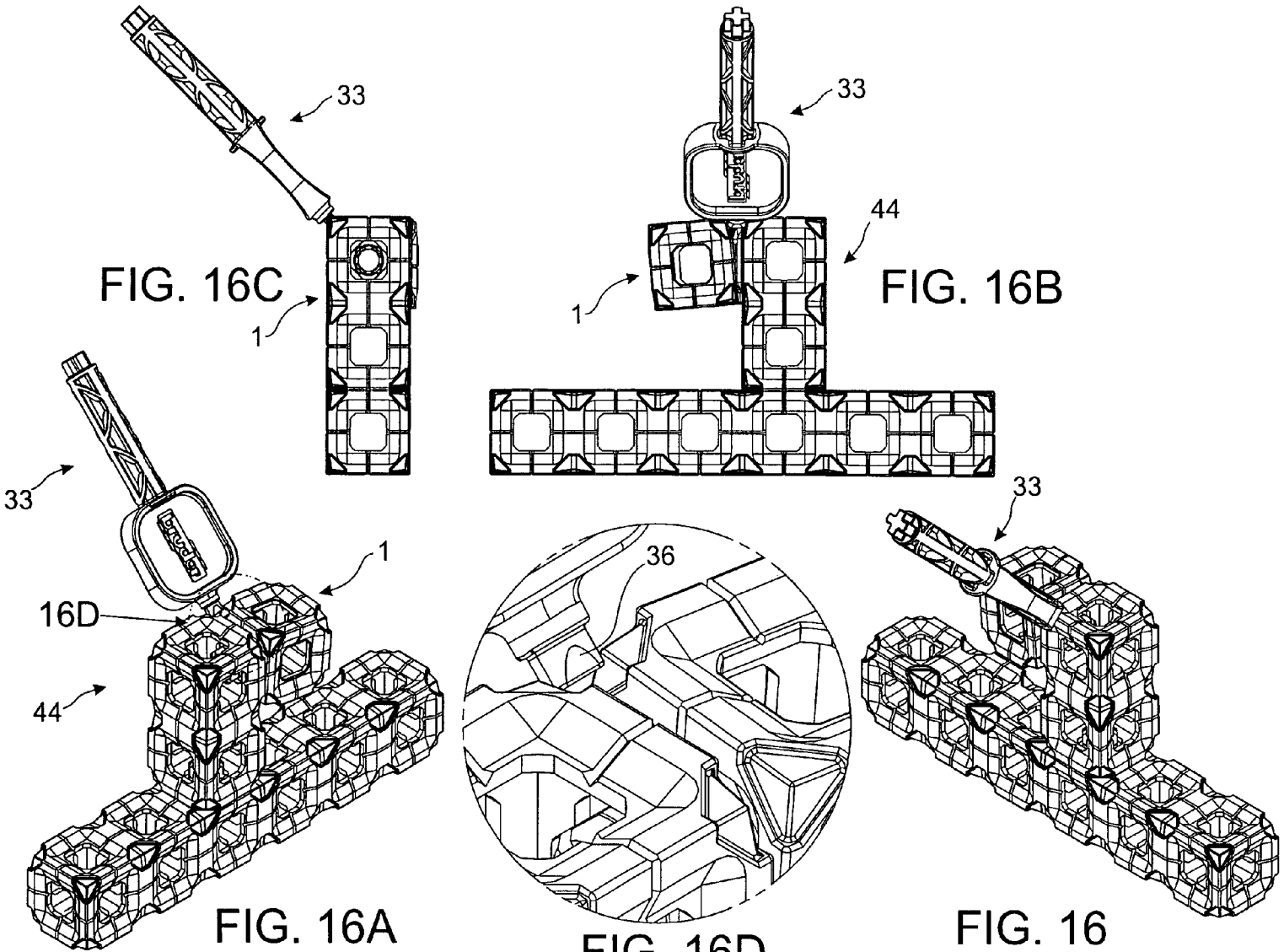
FIG. 16 to FIG. 16D the structure in accordance with FIGS. 14 and 15 with completely rotated disassembly tool.

The disassembly by the tool 33 is illustrated in FIGS. 14, 15 and 16. The projecting wedge 36 of the tool 33 is inserted into the common cut-out 15 of the adjacent building blocks 1, 44 as shown in FIG. 14. The tool 33 is subsequently rotated about its longitudinal axis so that it first adopts the position which is shown in FIG. 15, which corresponds to a rotation of the tool 33 of about 30°. The corners of the adjacent building blocks 33, 44 are moved apart by the wedge 36. After a rotation by 90°, the position which is shown in FIG. 16 is reached, in which the building block 1 is released from the building block 44.

The invention claimed is:

1. A construction system comprising:

a) a plurality of building blocks (1), each having a square assembly opening (2) which is surrounded by an assembly funnel (3), wherein the assembly funnel (3) comprises oblique planar surfaces (10, 11, 12, 13); and, b) at least one connector for connecting building blocks (1), each connector having two latching noses (17) and an assembly elevation (18, 25), wherein the assembly elevation (18, 25) is formed as a roof surface or as a pyramid surface.

2. The construction system in accordance with claim 1, wherein adjacent sides (4, 5, 6, 7) of the square assembly opening (2) are connected by extended corner surfaces (8).

3. The construction system of claim 1, wherein adjacent sides (4, 5, 6, 7) of the square assembly opening (2) are connected by extended corner surfaces (8), wherein the corner surfaces are rounded.

4. The construction system in accordance with claim 1, wherein the assembly funnel (3) comprises a circumferential terrace surface (9).

5. The construction system in accordance with claim 1, wherein the building block is formed as a polyhedron.

6. The construction system in accordance with claim 1, wherein the building block has a plurality of assembly openings (2).

7. The construction system in accordance with claim 1, wherein the building block is formed as an edged element.

8. The construction system in accordance with claim 1, wherein the building block has a cut-out (15) at one or more or all corners.

9. The construction system in accordance with claim 1, wherein the connector includes two further latching noses (24).

10. The construction system of claim 1, wherein two or four further latching noses (23, 29) and a further assembly elevation are provided on the opposite side of the connector (16, 18).

11. The construction system of claim 10, wherein one or more or all latching noses (17, 24; 23, 29) are resilient.

12. The construction system in accordance with claim 1, further including an assembly and disassembly tool (33), characterized by an eccentric protrusion (35) which can be plugged into a corresponding mount of the connector.

13. The construction system in accordance with claim 12, wherein the eccentric protrusion (35) has a cross-shaped cross-section.

14. The construction system in accordance with claim 13, wherein the tool has a projecting wedge (36).

15. The construction system in accordance with claim 12, wherein the tool has a projecting wedge (36).

16. The construction system of claim 1 wherein the connector is rotatable after insertion into the square assembly opening (2) of the building block (1) so as to cause a locking engagement of the latching nose (17) with a side of the square assembly opening (2).

17. The construction system of claim 16 wherein the latching nose (17) is alignable with a corner of the square assembly opening (2) to permit insertion of the connector into the square assembly opening (2), and wherein the latching nose is brought into locking engagement with the side of the square assembly opening (2) by about a 45° rotation of the connector.

18. A building block comprising a square assembly opening (2) which is surrounded by an assembly funnel (3) comprising oblique planar surfaces (10, 11, 12, 13) defining a funnel inner periphery wherein adjacent sides (4, 5, 6, 7) of the square assembly opening (2) are connected by extended corner surfaces (8), wherein the corner surfaces are planar.

19. The building block of claim 18 wherein the assembly funnel (3) comprises a circumferential terrace surface (9).

20. A building block comprising a square assembly opening (2) which is surrounded by an assembly funnel (3) comprising oblique planar surfaces (10, 11, 12, 13) defining a funnel inner periphery wherein adjacent sides (4, 5, 6, 7) of the square assembly opening (2) are connected by extended corner surfaces (8), wherein the corner surfaces are rounded.

21. The building block of claim 20 wherein the assembly funnel (3) comprises a circumferential terrace surface (9).

* * * * *